US005671550A

United States Patent [19]

Westelaken

[11] Patent Number: 5,671,550

[45] Date of Patent: Sep. 30, 1997

[54] PROPORTIONING PARTICULATE CONVEYING APPARATUS

[76] Inventor: Christianus M. T. Westelaken, P.O. Box 1349, Grand Bend, Ontario, Canada, NOM-ITO

[21] Appl. No.: 353,124

[22] Filed: Dec. 9, 1994

[51] Int. Cl.[6] ..... F26B 17/12

[52] U.S. Cl. ..... 34/167; 34/174; 34/179; 198/525

[58] Field of Search ..... 34/167, 174, 179, 34/208, 225; 198/525, 534, 550.13, 530; 222/328

[56] References Cited

U.S. PATENT DOCUMENTS

| | | | |
|---|---|---|---|
| 3,148,763 | 9/1964 | Sawada | 198/525 |
| 3,399,466 | 9/1968 | Hartley | 34/167 |
| 4,152,841 | 5/1979 | Westelaken | 34/167 |

FOREIGN PATENT DOCUMENTS

| | | | |
|---|---|---|---|
| 441122 | 12/1965 | Switzerland | 198/530 |

*Primary Examiner*—F. Daniel Lopez
*Attorney, Agent, or Firm*—Luedeka, Neely & Graham, P.C.

[57] ABSTRACT

The invention relates to a particulate conveying apparatus for evenly drying particulate material. The apparatus comprises a plurality of spatially separate, essentially parallel, vertically oriented proportioning plates, disposed between a first end and a discharge end of the conveying apparatus for flow of particulate material therebetween. An endless conveyor is positioned proximate to and below the bottom edge of the proportioning plates for receiving of particulate material flowing between the plates from the first end to the discharge end of the conveying apparatus. The plates each have side edges that vary a preset distance from one side edge to an opposing side edge of the plate.

18 Claims, 7 Drawing Sheets

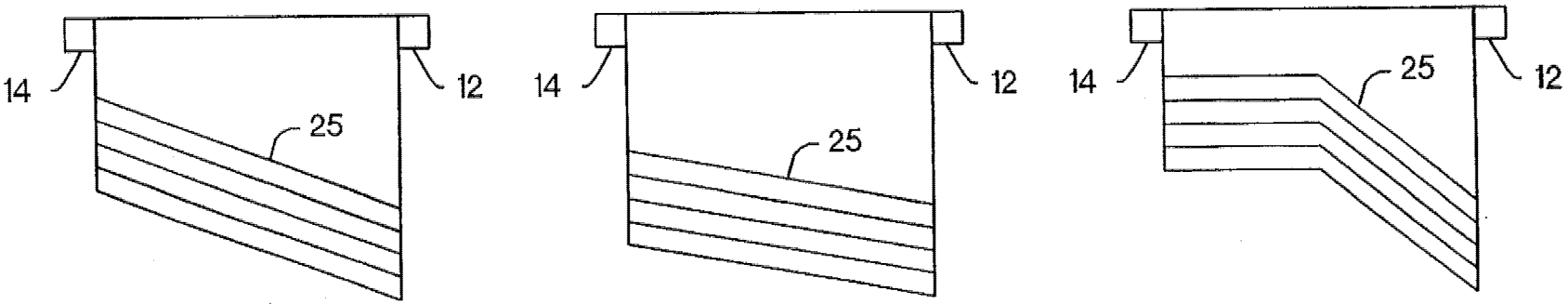
FIGURE 6a
FIGURE 6c
FIGURE 6e
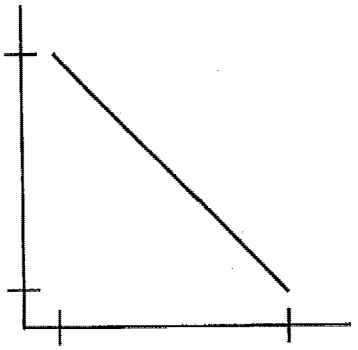
FIGURE 6b
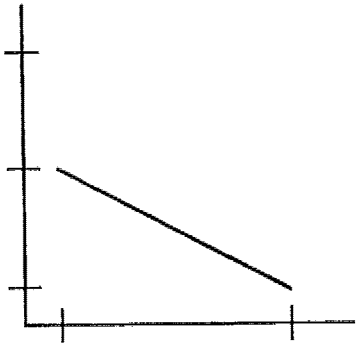
FIGURE 6d
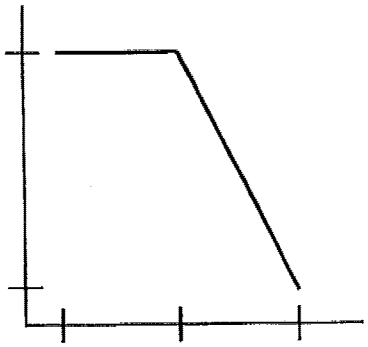
FIGURE 6f

PROPORTIONING PARTICULATE CONVEYING APPARATUS

FIELD OF THE INVENTION

The invention relates to particulate material conveyors and discharge systems, and more particularly to particulate material conveyors for use in cross-flow grain dryers.

BACKGROUND

The drying of large quantities of particulate or powdery materials to a desired moisture content provides difficulties, especially for heat sensitive materials such as grain. Without uniform drying, degradation of heat sensitive materials may occur in the hot areas of the dryer, while other areas of the dryer may not sufficiently dry the particulate material without prolonged drying times.

There is a balance that must be met, therefore, between the drying time and the drying temperature that is used to dry the particulate material, particularly if the particulate material is prone to degradation from overheating. For example, if grain is heated or cooled too quickly during the drying operation, the sudden temperature change may cause stress cracking and shattering of the grain. Such cracking or shattering of the grain greatly lowers the value of the grain, such that it may not be acceptable to many grain elevators and processors.

In some instances, uniformity of the moisture content of the dried particulate material is ultimately important. Excessive moisture in a portion of the particulate material after drying may present problems with handling, particularly if the material is prone to agglomeration in the presence of moisture. Furthermore, the presence of undesirable moisture may increase the corrosion rate of storage vessels containing particulate material such as halogenated catalysts and the like. In the foregoing examples, uniform drying of particulate material to a desired moisture level is an important consideration.

Many systems have been developed over the years which are intended to heat and uniformly dry particulate material, such as grain, while at the same time avoiding problems associated with drying heat sensitive materials. One such system is the cross-flow column type particulate material dryer, in which heated gas is transversely forced through a vertically moving column of particulate material to dry the material. Because the heated gas is hotter on the gas inlet side of the column of particulate material than on the gas outlet side of the column of particulate material, difficulties are encountered in trying to provide uniform drying across the column of particulate material in the dryer. Particulate material closest to the hot gas inlet will generally be dried faster and to a greater degree than material on the opposite side of the column from the hot gas inlet.

It is an object of the invention to provide an improved cross-flow dryer.

Another object of the invention is to improve the drying of a column of particulate material in a cross-flow dryer.

Still another object of the invention is to provide a means for moving a column of particulate material in a manner that provides even drying across the column perpendicular to the direction of particulate material flow, so that all of the material exiting the bottom of the column is dried to the same degree.

Other objects and benefits of the invention will be evident from the ensuing discussion and appended claims.

SUMMARY OF INVENTION

With regard to the foregoing and other objects, the invention provides a proportioning discharge conveying apparatus for particulate material. The conveying apparatus has a first end and a discharge end, and a plurality of spatially separate, essentially parallel, vertically oriented proportioning plates disposed between the first end and the discharge end, for flow of particulate material therebetween. Each plate has side edges, a top edge, and a bottom edge. An endless particulate material conveyor is proximate to, and positioned below the bottom edge of the proportioning plates. The particulate material conveyor receives particulate material flowing between the plates, and moves a predetermined amount of particulate material from the first end to the discharge end of the conveying apparatus. The distance between the bottom edge of each plate and the conveyor varies a preset distance from one side edge to an opposing side edge of the plate.

In a preferred embodiment the distance between the bottom edge of each plate and the conveyor also varies from the first end to the discharge end of the conveying apparatus. The distance between the plates and the conveyor is preferably a linear function of the position of the plate between the first end and the discharge end. In another embodiment, the plates may be adjustably attached to a rigid elongate member at their side edges, so that the distance between each plate, or between the bottom edge of the plates and the conveyor may be adjustable over the length of the conveying apparatus from the first end to the discharge end. It is preferred, however, that the plates be fixedly attached to a rigid elongate member, in order to assure more consistent drying of particulate material.

In still another preferred embodiment, a deflector may be attached to the top edge of each proportioning plate to distribute the weight of the particulate material above the plates, before it passes between the plates to the conveyor. The deflectors are dimensioned and angled upwardly from the top edge of each plate, from the discharge end to the first end of the apparatus, to substantially overlie at least a portion of the horizontal distance between adjacent plates. The foregoing modifications may be present in any one of a number of different combinations in various embodiments of the invention.

BRIEF DESCRIPTION OF DRAWINGS

The present invention may best be understood by reference to a detailed description of preferred embodiments when considered in conjunction with the following drawings, in which:

FIGS. 6 *a–f* are end views of proportioning plates exhibiting different bottom edge shapes.

DETAILED DESCRIPTION OF INVENTION

Figure 1:
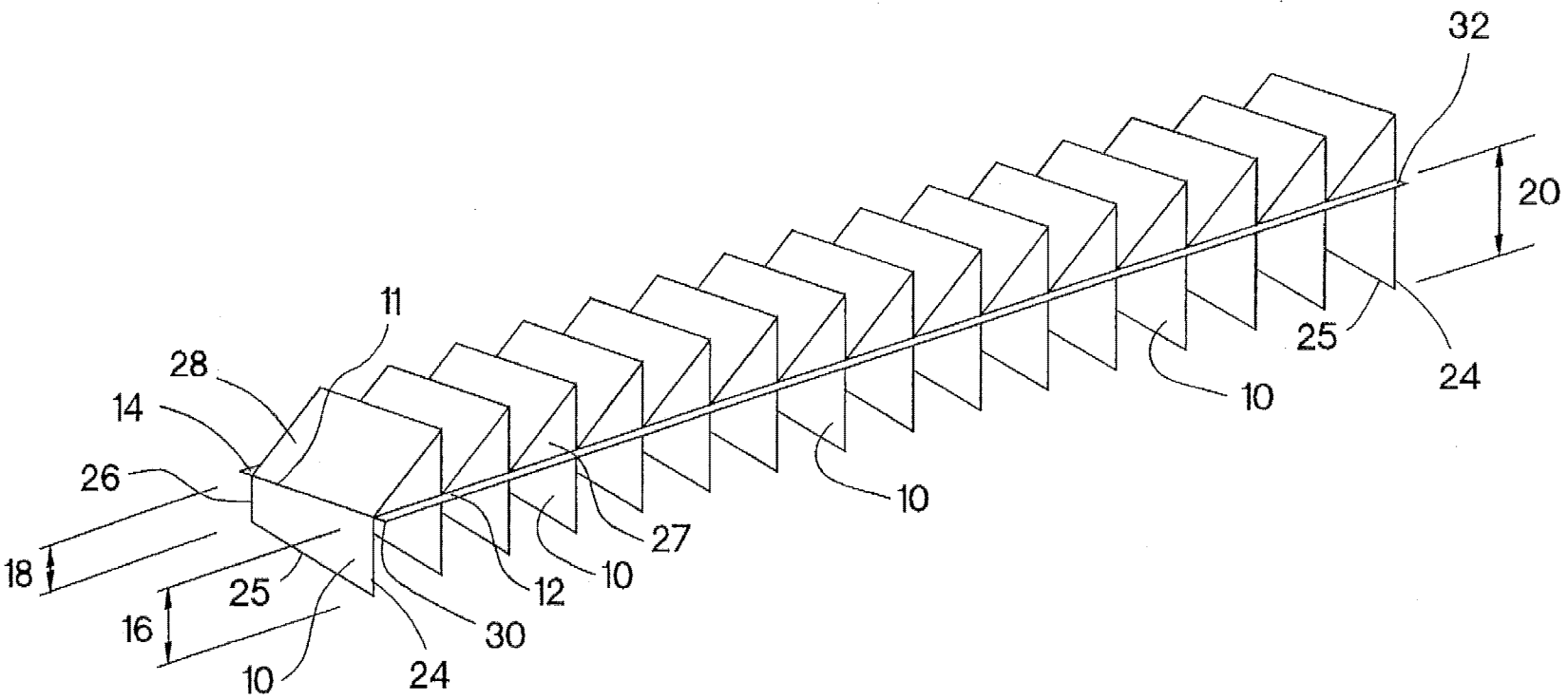
FIG. 1 is a perspective view of the plate and deflector portions of the proportional conveying apparatus.

Referring now to the drawings in which like reference characters designate like or corresponding parts throughout the several views, there is shown in FIG. 1 a preferred embodiment of a portion of the particulate material conveying apparatus according to the present invention. A plurality of proportioning plates 10 are spaced, preferably at preset intervals along the length of at least one rigid member, and preferably at least two rigid members, 12 and 14. The proportioning plates 10 are arranged so as to be parallel with respect to each other, so that particulate material can flow between each plate.

As can be seen in FIG. 1, the side edge 24 of the proportioning plate 10 nearest the discharge end 30, having a depth 16, is shorter than the corresponding side edge 24 of the proportioning plate 10 that is nearest the first end 32 of the conveying apparatus, which has a depth 20. In other words, the side edge 24 of the proportioning plate 10 at the discharge end 30 does not extend to as great a depth below the rigid member 12 as does the side 24 of the proportioning plate 10 at the first end 32.

The proportioning plates 10 between the first end 32 and the discharge end 30 typically extend to various depths below rigid member 12. Due to the weight of material to be conveyed, the maximum height of the plates at the first end 32 is about 9 inches. A height of about 6 inches is suitable for most particle drying applications. The depth to which each individual proportioning plate 10 extends will be determined according to a first predetermined function. In the preferred embodiment, this function is preferably a linear function of the position of the plate between the first end and the discharge end of the conveying apparatus. In the alternative the depth of each plate may vary in a non-linear amount from the first end to the discharge end of the conveying apparatus, thus providing for a variable degree of drying of particulate material as will be explained in more detail below. For an extremely long conveying apparatus one or more plates may be identical to an adjacent plate thereby forming a set of identical plates, each set of plates varying in a non-linear amount from the first end to the discharge end of the conveying apparatus.

As can also be seen in FIG. 1, the length 18 of side 26 of proportioning plate 10 is preferably less than length 16 of side 24 of proportioning plate 10. The lengths of the edges of each plate will be determined according to a second predetermined function. In the preferred embodiment, this function is also a linear function, related to the width of the plate, and the position of the plate between the inlet and discharge ends of the conveying apparatus. Accordingly, the bottom edge 25 of each proportioning plate 10 will form a straight line between sides edges 24 and 26. In an alternate embodiment the function may be a non-linear function related to the distance each side edge is from the conveyor. Accordingly, the conveyor will provide for a variable degree of drying from one side of a column of particulate material to an opposing side, as will be explained in more detail below.

In a preferred embodiment according to the present invention there are also present a plurality of deflectors 28 pending from a top edge 11 of the proportioning plates 10. The deflectors 28 are oriented upwardly at an angle toward the first end 32, so that they substantially overlie the at least a portion of the space between adjacent proportioning plates 10. In an alternate embodiment, each deflector 28 overlaps at least a portion of an adjacent deflector 28, however, it is preferred that the deflector terminate at the adjacent proportioning plate in order to reduce frictional losses for flow of particulate material between the plates. The deflectors 28 carry and distribute the weight of particulate material above the apparatus thereby reducing the vertical load and travel shear friction on a conveyor positioned below the proportioning plates for receiving and urging particulate material from the first end to the discharge end of the apparatus. The deflector plates 28 may be supported in their angular orientation by triangular side panels 27 attached on one or both sides of deflector plates 28.

Figure 2:
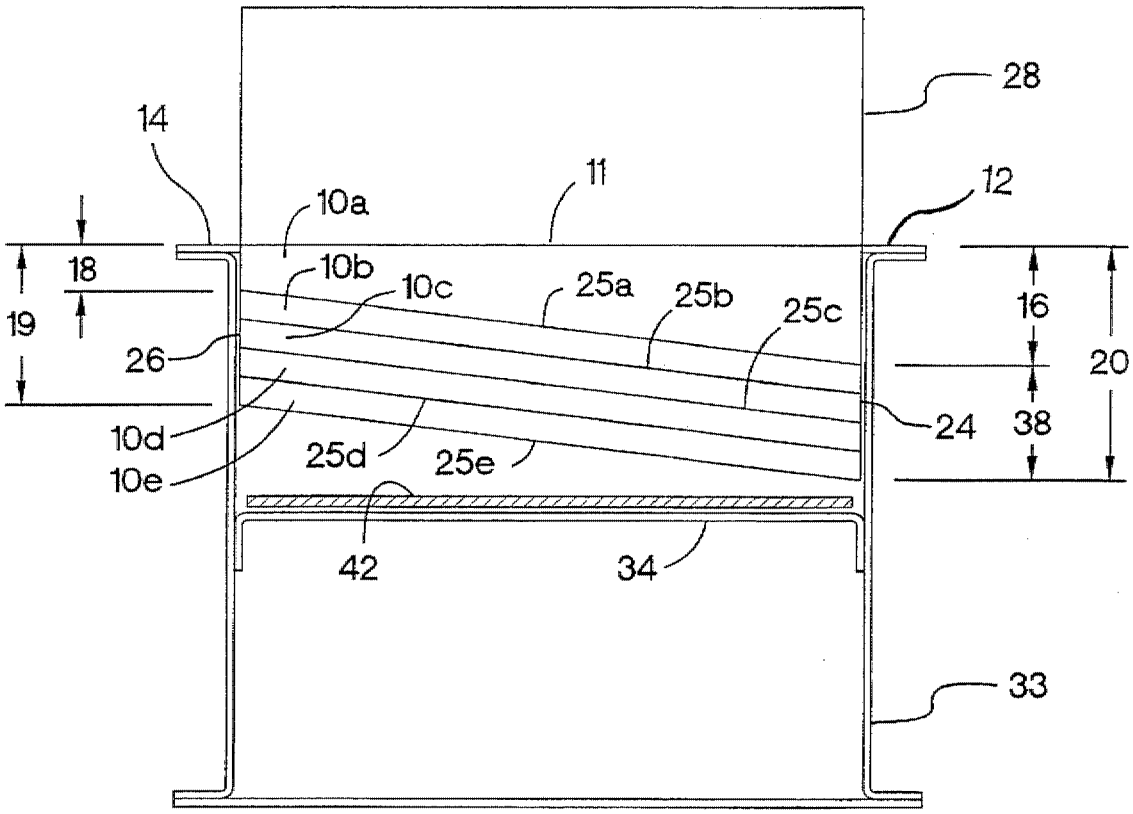
FIG. 2 is an end view of part of a proportional conveying apparatus viewed from the discharge end to the inlet end.

Turning now to FIG. 2 there is shown an end view of part of the proportional conveying apparatus. In this embodiment, the rigid members 12 and 14 have been incorporated into a channel 33 having a base plate 34. Positioned above base plate 34 is a movable conveyor 42. Proportioning plate 10*a* can be seen in the figure, and behind it can be seen the lower portions of proportioning plates 10*b* through 10*e*. It will be appreciated that in the preferred embodiment there can be any number of proportioning plates 10 used in the conveying apparatus. The number of proportioning plates 10 used will be a function of the distance between the first end 32 and the discharge end 30 (FIG. 1) of the conveying apparatus, and how fine a degree of control of the flow of particulate material is desired. In this example only five proportioning plates 10 are shown for the sake of clarity.

Bottom edges 25*a* through 25*e* of plates 10*a* through 10*e* extend to different depths below the rigid members 12 and 14. As can be seen, this will allow for a different amount of particulate material to pass between the bottom edges 25*a* through 25*e* and the conveyor 42. Not only will a different amount of particulate material pass under the different proportioning plates 10*a* through 10*e*, but a different amount of particulate material will pass under each point along the bottom edge 25 of each plate 10, because side edge 26 is shorter than side edge 24 for each plate except for the plate adjacent to the first end 32. At the first end 32, the plate preferably has side edges 24 and 26 which are substantially the same length in order to prevent material from accumulating near the first end 32. By varying the depth to which each proportioning plate 10 extends, and the depth to which side edges 24 and 26 extend, more complete control over the movement of particulate material over the length and width of the conveying apparatus can be obtained.

The functions used to determine the distances between side edges 24 and 26 and conveyor 42 are related to the material being dried. Accordingly for materials similar to rice, the ratio of the distance between side edge 26 and conveyor 42 to side edge 24 and conveyor 42 is preferably about 3:1. For corn, the ratio of the distance between side edge 26 and conveyor 42 to side edge 24 and conveyor 42 is preferably about 2:1 and for wheat the ratio is about 2.5:0.875. These ratios are preferably maintained from the first end 32 to the discharge end 30 of the conveying apparatus.

Figure 3:
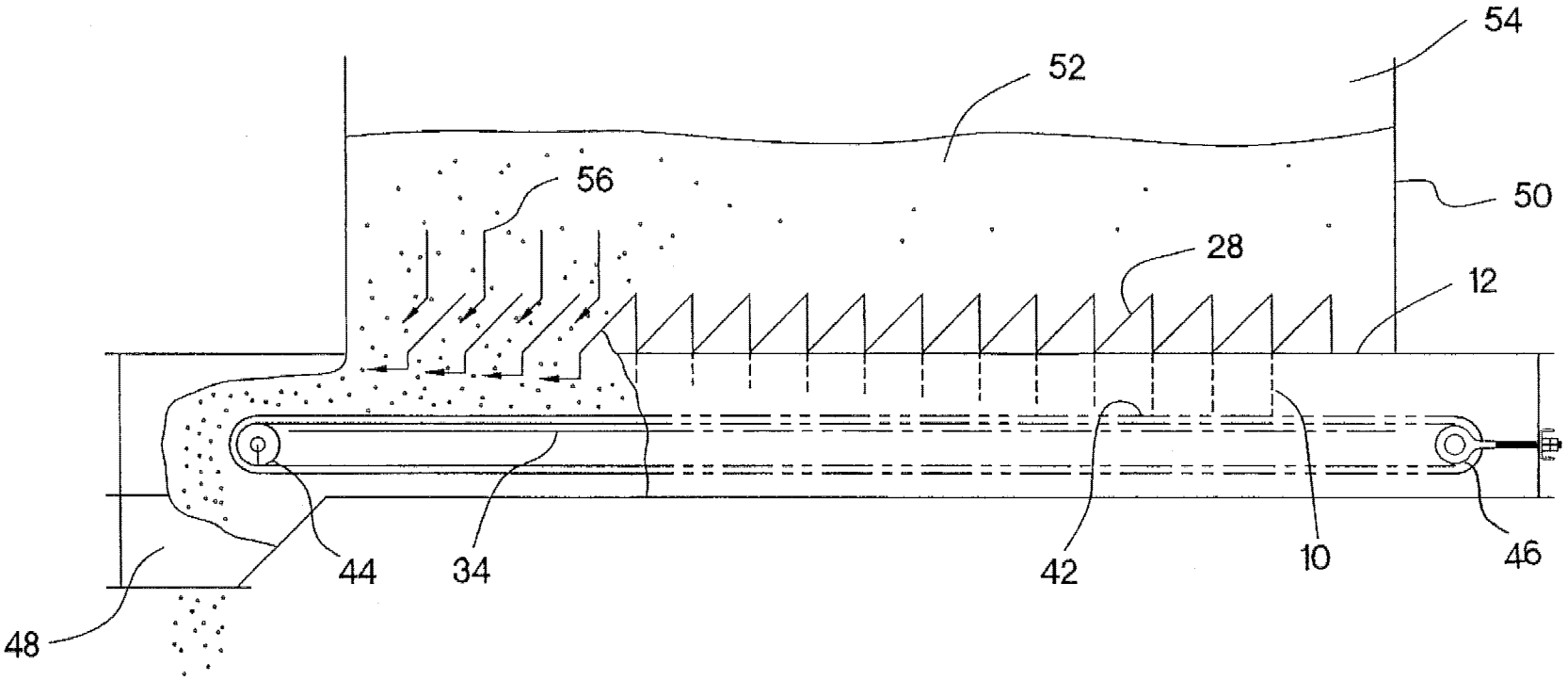
FIG. 3 is a cross-sectional side view of a portion of the proportional conveying apparatus, positioned in a dryer below a column of particulate material.

FIG. 3 provides a cross-sectional side view of the proportional conveying apparatus of the invention as it could be used in a particulate material holding bin or dryer. The particulate material 52 is in a hopper 50 located above the rigid members 12 and 14 (not shown), and proportioning plates 10. As can be seen in this figure, the deflector plates 28 bear the weight of the particulate material 52 above the particulate conveying apparatus, before it enters between the proportioning plates 10.

Below the proportioning plates 10, and above the base plate 34 of frame 33, is a conveyor 42, preferably an endless belt conveyor, which revolves on motor drive shafts 44 and 46. The conveyor 42 urges the particulate material 52 between plates 10 toward the outlet end 48 of the conveying apparatus. In alternate embodiments the conveyor 42 could utilize any one or more of chains, bars, baskets, and the like to aid in moving the particulate material 52 toward the outlet 48.

Figure 4:
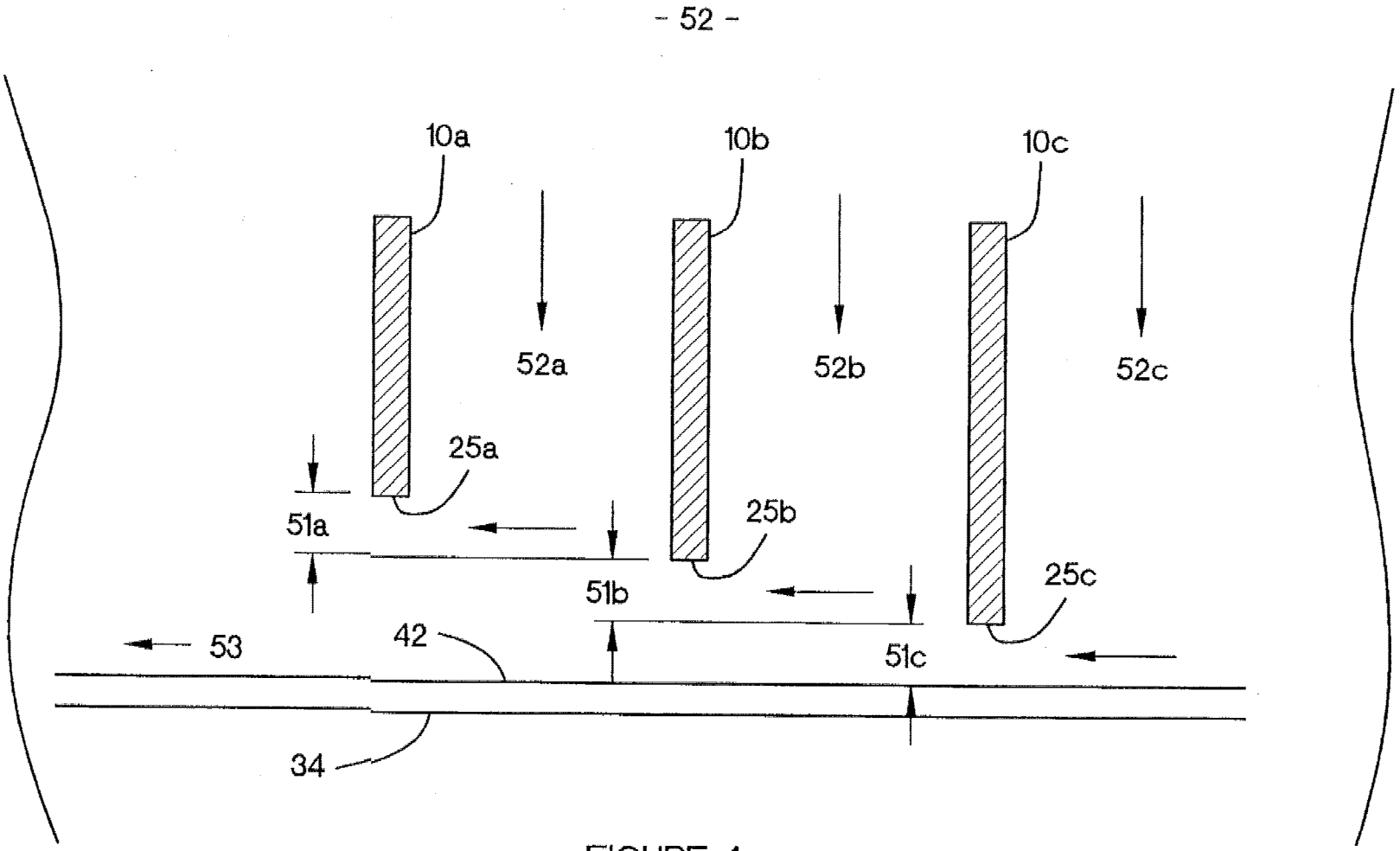
FIG. 4 is a cross-sectional side view of a proportional conveying apparatus showing the flow of particulate material under the proportioning plates.

FIG. 4 is a partial view, in cross-section, of the conveyor apparatus of FIG. 3. Particulate material 52*a* through 52C flows between proportioning plates 10*a* through 10*c*. Because bottom edges 25*a* through 25*c* vary in their proximity to conveyor 42, a different amount of particulate material can pass between bottom edges 25*a* through 25*c* and the conveyor 42. An amount 51*c* can pass under plate 10*c*, an additional amount 51*b* can pass under plate 10*b*, and an additional amount 51*a* can pass under plate 10*a*. If the depth of plates 10*a* through 10*c* are set so that amounts 51*a* through 51*c* are equal, then the amount of particulate material 53 withdrawn by conveyor 42 between plates 10*a* through 10*c* will be substantially the same throughout the length of the hopper 50 (FIG. 3).

Figure 5:
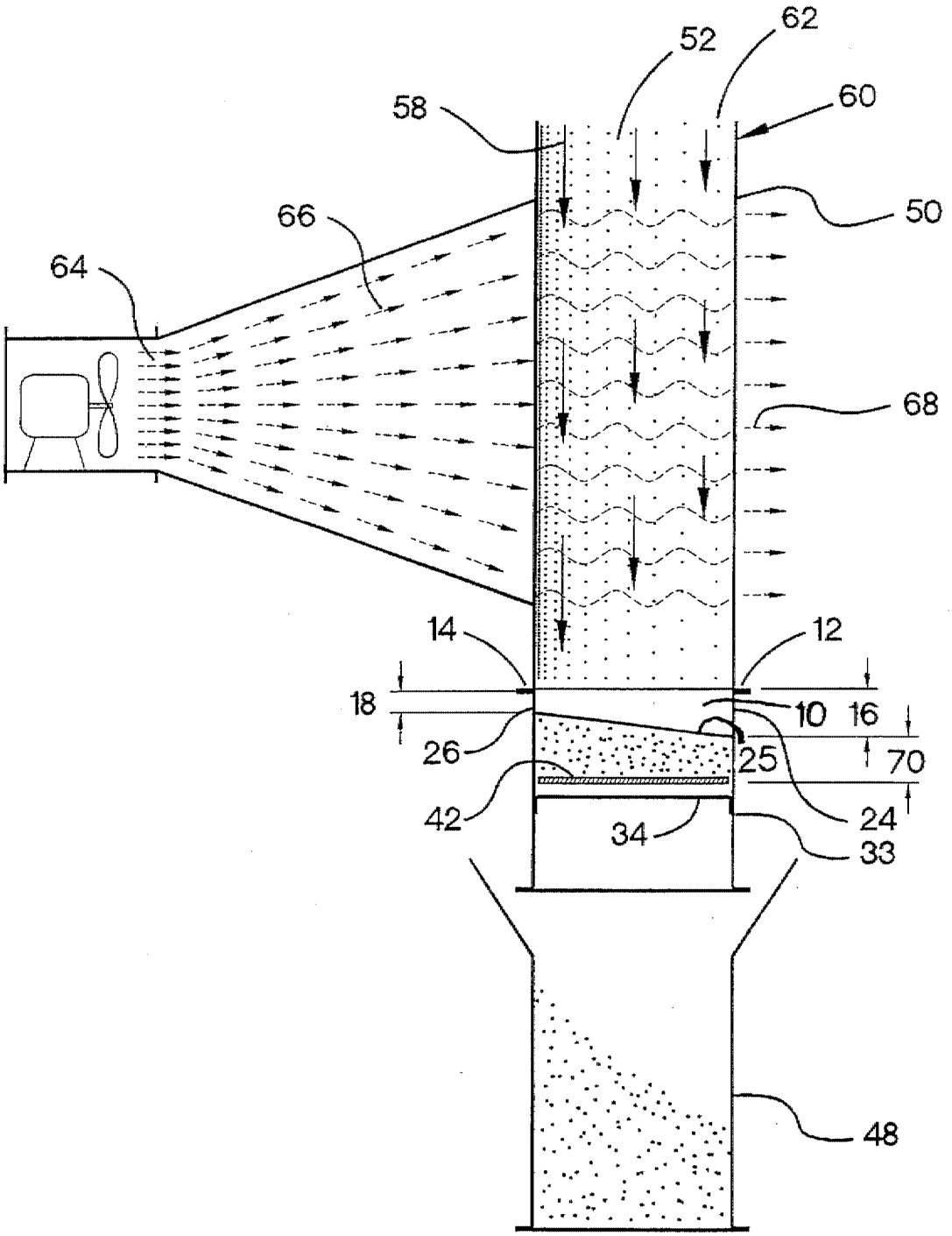
FIG. 5 is a cross-sectional end view of a particulate material conveying apparatus illustrating the downward flow of particulate material in a cross-flow dryer.

FIG. 5 illustrates a cross-sectional end view of the proportional conveying apparatus of the invention as it could be used in a cross-flow dryer. The particulate material 52 enters the hopper 50 in an upper portion of the hopper 62. Foraminous sidewalls 58 and 60 of the hopper enclose a column of particulate material 52 so that drying gas can be forced through the particulate material 52 in a direction transverse to the direction of material flow in the hopper. In an alternative embodiment the gas can be passed through a conditioning system 64, that can heat, cool, humidify, or dry the gas before it contacts the column of particulate material As has been discussed above, because side edge 26 of proportioning plate 10 does not extend to as great a depth as side edge 24, a greater amount of particulate material 52 can pass under the proportioning plate 10 at side edge 26 than can pass under the plate 10 at side edge 24. Therefore, the particulate material 52 closer to sidewall 58 of the hopper 50 will move vertically downward at a greater rate than the particulate material 52 closer to the sidewall 60 of the hopper.

Control of movement of particulate material on the inlet gas side of the hopper is important to a heating or cooling system as illustrated in FIG. 5. In the case where conditioner 64 heats the gas that is to contact the particulate material 52, heated gas 66 will enter the column of particulate material 52 through foraminous sidewall 58, and contact particulate material 52 that is relatively cool as compared to the heated gas 66. The coolness of the particulate material 52 will in turn tend to cool the gas 66 as it passes through the column of particulate material, so that the gas 68 exits through foraminous sidewall 60 at a lower temperature than the inlet gas 66.

If, in addition to warming the particulate material 52, the inlet gas stream 66 is also more arid than the particulate material 52, then the gas 66 will dry the particulate material as it traverses the hopper 50, and will exit through foraminous sidewall 60 in a more humid state than its condition prior to contacting the particulate material.

As will be appreciated from the foregoing, the gas passing through the particulate material 52 changes properties, such as temperature and humidity, as it flows between foraminous sidewalls 58 and 60. Therefore, particulate material 52 closer to the sidewall 58 will be subjected to gas having different properties than the gas that contacts the particulate material 52 closer to the sidewall 60. If all the particulate material 52 between sidewalls 58 and 60 had the same resident time within the hopper 50, the particulate material 52 at the bottom of hopper 50 would vary in temperature and humidity characteristics across the hopper 50.

Because a greater amount of particulate material can pass under the proportioning plate 10 at side edge 26, which underlies sidewall 58 of hopper 50, the particulate material 52 closest to sidewall 58 will move downwardly at a faster rate than that particulate material 52 closer to sidewall 60 that must pass under side edge 24 of proportioning plate 10 to reach conveyor 42. Thus, the particulate material 52 closest to sidewall 58 will have a shorter residence time within the hopper 50 than the particulate material 52 closest to the sidewall 60.

Since the particulate material 52 with the shorter residence time is subjected to the hotter, drier gas 66, and the particulate material 52 with the longer residence time is subjected to the cooler, moister gas 68, the temperature and moisture properties of the particulate material 52 at the bottom of the column will tend to have more uniform properties. In fact, by controlling the second function which determines the shape of the bottom edge 25 of the proportioning plate 10, an essentially precise degree of uniformity can be achieved in the properties of the particulate material 52 discharged from the dryer by the conveying apparatus of the invention.

Looking now at FIGS. 6*a* through 6*f*, there are shown proportioning plates 10 with bottom edges 25 shaped according to different functions. FIG. 6*a* shows a proportioning plate 10 with a steeper bottom edge 25 than the proportioning plate 10 depicted in FIG. 6*c*. The functions which govern the shape of the bottom edges 25 are depicted in FIGS. 6*b* and 6*d* respectively. The sharper angle depicted in FIG. 6*a* would be useful for drying particulate material wherein the properties of the drying gas change rapidly from one side of a column of particulate material to the opposing side, as the gas moves through the particulate material. Accordingly there is a need to decrease the residence time of the particulate material from one side of the column to the other.

The shallower angle depicted in FIG. 6*c* would be useful in a drying system wherein the properties of the drying gas change more slowly as the gas moves through the column of particulate material. Accordingly the difference in residence time of the particulate material from one side of the column to the opposing side need not be as pronounced.

In FIG. 6*e* there is shown a proportioning plate with a bottom edge 25 following the function as depicted in FIG. 6*f*. Such a proportioning plate would be useful in a cross-flow drying system wherein the drying gas 66 properties entering one side of a column of particulate material remain relatively constant until the gas has penetrated part way through the particulate material, and then the properties of the dry gas change rapidly through the rest of the material. Therefore, the bottom edge 25 of plate 10 allows a constant high rate of discharge of particulate material across a portion of the column of the particulate material, and then the amount of particulate material 52 that can exit the conveying apparatus is reduced in a linear fashion thereby, increasing the residence time of the particulate material 52 above that portion of the conveying apparatus.

Figure 7A:
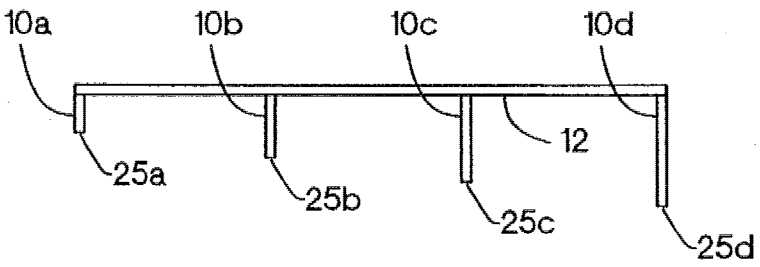
FIGS. 7 *a–d* are cross-sectional side views of proportioning plates exhibiting different plate bottom edge to conveyor spacings.
Figure 7B:
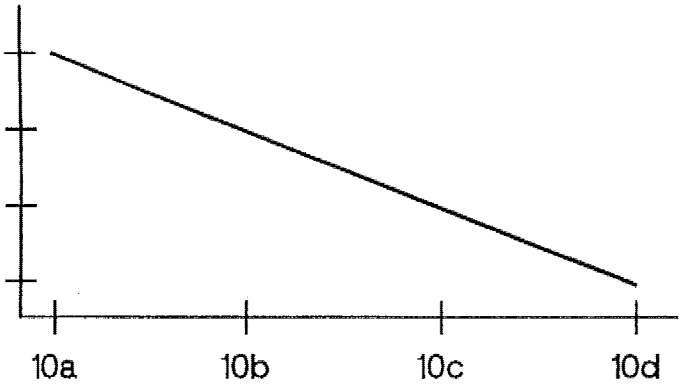
Figure 7C:
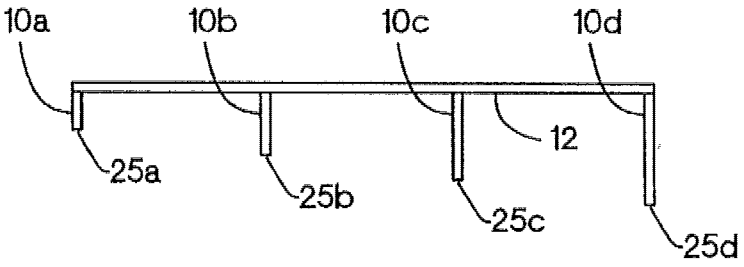

In a similar fashion, there is shown in FIGS. 7*a* through 7*d* proportioning plates 10 fashioned according to different first functions. FIG. 7*a* shows proportioning plates 10 made according to the linear function depicted in FIG. 7*b*. FIG. 7*c* shows proportioning plates 10 made according to the function depicted in FIG. 7*d*. The linear function of FIG. 7*b* would be useful in a dryer system where the properties of the drying gas stream 66 are relatively consistent across the entire length of the conveying apparatus.

Figure 7D:
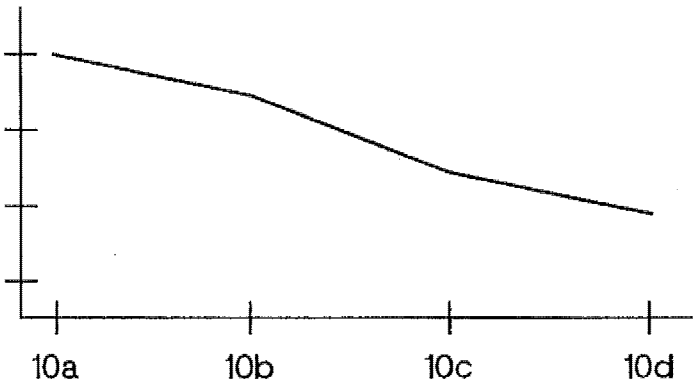

The function of FIG. 7*d* would be useful in a dryer system where the properties of the drying gas vary in a non-linear fashion from the first end to the discharge end of the conveying apparatus. In this example, a longer residence time is given to the particulate material 52 at each end of the conveying apparatus, and a shorter residence time is given to the particulate material 52 near the center of the conveying apparatus. This would be beneficial to a particulate dryer, for example, wherein the drying gas at the first end and the discharge end of the conveying apparatus is cooler than the drying gas near the center of the conveying apparatus.

As can be appreciated from the discussion above, an infinite variety of first and second functions could be used in the design of the proportioning plates 10 so as to control the residence time of particulate material 52 along the length of the conveying apparatus, thus achieving a precise degree of control over the uniformity of the properties of the particulate material 52 exiting the dryer. It is also evident that the first function and the second function can be controlled independently of one another.

While in the preferred embodiment the proportioning plates 10 are fixedly attached to the rigid elongate members 12 and 14, in an alternate embodiment they are adjustably attached to the rigid elongate members. Adjustable attachments provide for changing the first and second functions, so that the particulate material dryer can be finely tuned, or changed for a different particulate material or drying rate.

In one such alternate embodiment, the proportioning plates 10 have a series of slots or detents along each side edge 24 and 26, and are suspended by these slots or detents from protrusions pending inwardly from the rigid elongate members 12 and 14. In this manner the height of the proportioning plates 10 above the conveyor 34 can be readily adjusted. The proportioning plates 10 can also be swapped out for other proportioning plates 10 having a bottom edge shaped according to a different first and second functions. In addition, proportioning plates 10 could be either added or removed from the conveying apparatus, thus decreasing or increasing respectively the distance between proportioning plates 10, and allowing for finer or coarser control over the proportioning affect of the conveying apparatus.

In order to illustrate the advantages of the invention, various grain was dried using the conveying apparatus of this invention in a full scale cross-flow dryer and the drying characteristics of the grain were compared to the drying characteristics of the same type of grain dried in a cross-flow dryer using a conventional conveyor system. In all of the Tables 2–6 samples of the grain were taken every 15 or 30 minutes and the average wet bulb or temperature of the grain was a measure of the composite of all of the samples. In Table 1, each grain was dried from 19 to 14 percent wet bulb moisture content with the indicated dryer operating conditions.

TABLE 1

| Parameter | Corn[1] | Sorghum | Soybeans |
|---|---|---|---|
| Drying Temperature (°F.) | 200 | 200 | 140 |
| Dryer Air Velocity (ft/min) | 77 | 89 | 92 |
| Dryer Static Pressure (inches of water) | 1.9 | 1.7 | 1.6 |

TABLE 1-continued

| Parameter | Corn[1] | Sorghum | Soybeans |
|---|---|---|---|
| Cooler air velocity (ft/min) | 108 | 126 | 138 |
| Cooler Static Pressure (inches of water) | 3.5 | 3.0 | 2.8 |
| Horsepower (HP/ft$^2$) | 2.35 | 2.35 | 2.35 |
| Dry Capacity (bushels/hr) | 950 | 1030 | 670 |

[2]Medium Drying Hybrid

In the following tables, two cross-flow dryers were used each having the same drying column lengths and cooling column lengths. Stage 3 of the dryers was the cooling stage. One cross-flow dryer utilized the conveying apparatus of the invention to more evenly dry the grain. The other dryer contained conventional conveying apparatus. The grain in Tables 2 and 3 was corn which was dried at 200° F. from 19 percent wet bulb to 14 percent wet bulb. The dryer utilizing the conveying apparatus of the invention had a ratio of the distance between side edge 26 and conveyor 42 to side edge 24 to conveyor 42 (FIG. 2) of 2:1.

TABLE 2

| | Conveyor of the Invention 935 bushels/hour | | Conventional Conveyor 880 bushels/hour | |
|---|---|---|---|---|
| Dryer Stage | Plenum Side (% wet bulb) | Exhaust Side (% wet bulb) | Plenum Side (% wet bulb) | Exhaust Side (% wet bulb) |
| 1 Min. | 15.0 | 16.6 | 14.0 | 16.8 |
| Avg. | 16.3 | 17.5 | 15.2 | 17.7 |
| Max. | 17.5 | 18.2 | 16.4 | 18.5 |
| 2 Min. | 14.0 | 13.8 | 12.0 | 14.4 |
| Avg. | 14.5 | 14.1 | 13.0 | 15.4 |
| Max. | 14.8 | 14.4 | 14.0 | 16.3 |
| 3 Min. | 14.0 | 13.4 | 12.1 | 14.1 |
| Avg. | 14.3 | 13.7 | 12.9 | 15.0 |
| Max. | 14.5 | 14.0 | 13.7 | 16.0 |

TABLE 3

| | Conveyor of the Invention 935 bushels/hour | | Conventional Conveyor 880 bushels/hour | |
|---|---|---|---|---|
| Dryer Stage | Plenum Side (°F.) | Exhaust Side (°F.) | Plenum Side (°F.) | Exhaust Side (°F.) |
| 1 Min. | 166 | 133 | 173 | 134 |
| Avg. | 184 | 147 | 187 | 150 |
| Max. | 200 | 160 | 200 | 167 |
| 2 Min. | 175 | 155 | 183 | 157 |
| Avg. | 188 | 164 | 192 | 169 |
| Max. | 200 | 172 | 200 | 180 |
| 3 Min. | 60 | 155 | 60 | 133 |
| Avg. | 95 | 162 | 77 | 156 |
| Max. | 148 | 165 | 114 | 166 |

In Table 4, the dryer utilizing the conveying apparatus of the invention had a ratio of the distance between side edge 26 and conveyor 42 to side edge 24 to conveyor 42 (FIG. 2) of 3:1. Medium-drying corn hybrid was dried in Table 4 at 200° F. from 19 percent wet bulb to 14 percent wet bulb.

TABLE 4

| Dryer Stage | Conveyor of the Invention 1185 bushels/hour Plenum Side (% wet bulb) | Exhaust Side (% wet bulb) | Conventional Conveyor 945 bushels/hour Plenum Side (% wet bulb) | Exhaust Side (% wet bulb) |
|---|---|---|---|---|
| 1 Min. | 14.7 | 16.7 | 15.3 | 16.0 |
| Avg. | 16.5 | 17.7 | 16.6 | 16.8 |
| Max. | 18.0 | 18.6 | 17.7 | 17.6 |
| 2 Min. | 13.9 | 13.3 | 14.3 | 13.1 |
| Avg. | 14.5 | 13.7 | 14.6 | 13.4 |
| Max. | 15.1 | 14.1 | 15.0 | 13.7 |
| 3 Min. | 13.9 | 12.7 | 14.3 | 12.6 |
| Avg. | 14.3 | 13.1 | 14.5 | 12.9 |
| Max. | 14.7 | 13.6 | 14.7 | 13.2 |

In Table 5, the dryer utilizing the conveying apparatus of the invention had a ratio of the distance between side edge 26 and conveyor 42 to side edge 24 to conveyor 42 (FIG. 2) of 2:1. Corn was dried in Table 5 at 200° F. from 30 percent wet bulb to 15 percent wet bulb. As illustrated in this table, the advantages of the conveying apparatus of the invention are more pronounced with the higher inlet moisture content. Accordingly, there is much less difference in moisture content of the grain on the plenum side or inlet air side versus the grain on the exhaust air side of the drying column when the conveying apparatus of the invention is used in a cross-flow dryer.

TABLE 5

| Dryer Stage | Conveyor of the Invention 400 bushels/hour Plenum Side (% wet bulb) | Exhaust Side (% wet bulb) | Conventional Conveyor 370 bushels/hour Plenum Side (% wet bulb) | Exhaust Side (% wet bulb) |
|---|---|---|---|---|
| 1 Min. | 17.3 | 21.9 | 15.1 | 22.0 |
| Avg. | 20.7 | 25.4 | 17.9 | 25.4 |
| Max. | 24.0 | 28.9 | 20.8 | 28.7 |
| 2 Min. | 15.1 | 15.0 | 11.4 | 15.8 |
| Avg. | 16.2 | 15.8 | 13.1 | 18.4 |
| Max. | 17.2 | 16.5 | 14.9 | 21.2 |
| 3 Min. | 15.2 | 14.4 | 11.5 | 15.4 |
| Avg. | 16.0 | 15.0 | 13.1 | 17.6 |
| Max. | 16.7 | 15.5 | 14.7 | 20.0 |

A comparison of the drying properties of sorghum and soybeans being dried in a cross-flow dryer containing the conveying apparatus of this invention is given in Table 6. In this dryer, the conveying apparatus of the invention had a ratio of the distance between side edge 26 and conveyor 42 to side edge 24 to conveyor 42 (FIG. 2) of 3:1. The sorghum was dried at 200° F. and the soybeans were dried at 140° F. from 19 percent wet bulb to 14 percent wet bulb.

TABLE 6

| Dryer Stage | Sorghum 1030 bushels/hour Plenum Side (% wet bulb) | Exhaust Side (% wet bulb) | Soybeans 670 bushels/hour Plenum Side (% wet bulb) | Exhaust Side (% wet bulb) |
|---|---|---|---|---|
| 1 Min. | 14.9 | 16.4 | 13.9 | 16.9 |
| Avg. | 16.6 | 17.2 | 16.3 | 18.1 |
| Max. | 17.9 | 17.9 | 18.2 | 19.0 |
| 2 Min. | 13.8 | 13.2 | 13.0 | 13.7 |
| Avg. | 14.6 | 13.6 | 14.3 | 14.4 |
| Max. | 15.1 | 14.0 | 15.3 | 15.0 |
| 3 Min. | 13.8 | 12.5 | 13.1 | 12.9 |

TABLE 6-continued

| Dryer Stage | Sorghum 1030 bushels/hour Plenum Side (% wet bulb) | Exhaust Side (% wet bulb) | Soybeans 670 bushels/hour Plenum Side (% wet bulb) | Exhaust Side (% wet bulb) |
|---|---|---|---|---|
| Avg. | 14.4 | 13.0 | 14.1 | 13.7 |
| Max. | 14.9 | 13.4 | 14.9 | 14.3 |

Advantages of the cross-flow dryers containing the conveying apparatus of the invention, as illustrated by the foregoing full scale tests, include providing grain having less over-drying, less under-drying and a smaller moisture content gradient in the dried grain. The cross-flow dryers may also require less severe drying conditions with respect to time, temperature and relative humidity while providing increased capacity with improved energy efficiency.

While preferred embodiments of the present invention have been described above as the invention may be used in a dryer, preferably a cross-flow dryer, it will be appreciated by those of ordinary skill in the art that the invention is capable of various modifications and uses without departing from the spirit of the invention. Accordingly the invention can be applied to any particulate material conditioning system for humidification, drying, cooling, heating, and the like.

What is claimed is:

1. An essentially horizontal conveying apparatus for particulate material having a first end and a discharge end comprising:

a plurality of spatially separate, essentially parallel, vertically oriented proportioning plates disposed between the first end and the discharge end, each plate having side edges, a top edge, and a bottom edge, for flow of particulate material therebetween, and an endless particulate material conveyor, proximate to and below the bottom edge of the proportioning plates, for receiving particulate material flowing between the plates, and for moving a predetermined amount of particulate material from the first end to the discharge end of the conveying apparatus, wherein a distance between the bottom edge of each plate and the conveyor varies a preset distance from one side edge of the plate to an opposing side edge of the plate.

2. The conveying apparatus of claim 1 wherein the preset distance is a linear function of a position on the bottom edge of the plate from one side edge of the plate to an opposing side edge of the plate.

3. The conveying apparatus of claim 1 wherein the distance between the bottom edge of the plates and the conveyor varies from the first end to the discharge end, so that each succeeding plate is a further distance from the conveyor than each preceding plate.

4. The conveying apparatus of claim 3 wherein the distance between the bottom edge of each proportioning plate and the conveyor is a linear function of a position of the plate between the first end and the discharge end of the conveying apparatus.

5. The conveying apparatus of claim 1 further comprising a deflector attached to the top edge of each proportioning plate, for distributing weight of the particulate material above the plates before it passes between the plates to the particulate material conveyor.

6. The conveying apparatus of claim 5 wherein the deflector is dimensioned and angled upwardly from the top edge of each plate from the discharge end to the first end of the apparatus, to substantially overlie at least a portion of a horizontal distance between adjacent plates.

7. The conveying apparatus of claim 1 further comprising essentially parallel, elongate, rigid members on each side of the proportioning plates, for attachment of the side edges of the plates therebetween.

8. The conveying apparatus of claim 7 wherein the proportioning plates are adjustably attached to the rigid members, such that a horizontal distance between each plate can be varied over the length of the conveying apparatus.

9. The conveying apparatus of claim 7 wherein the proportioning plates are adjustably attached to the rigid members, such that the distance between the bottom edge of each plate and the particulate material conveyor can be varied over the length of the conveying apparatus.

10. A cross-flow dryer having a particulate material inlet in an upper portion thereof, a particulate material discharge in a lower portion thereof, and foraminous side walls disposed between the inlet and the discharge, for flow and drying of particulate material therebetween, further comprising:

an essentially horizontal particulate material conveying apparatus disposed above the discharge, for receiving particulate material flowing between the side walls, the conveying apparatus having a first end and a discharge end, and containing;

a plurality of spatially separate, essentially parallel, vertically oriented proportioning plates disposed between the first end and the discharge end, each plate having side edges, a top edge, and a bottom edge, for flow of particulate material therebetween, and an endless particulate material conveyor, proximate to and below the bottom edge of the proportioning plates, for receiving particulate material flowing between the plates, and for moving a predetermined amount of particulate material from the first end to the discharge end of the conveying apparatus, wherein a distance between the bottom edge of each plate and the conveyor varies a preset distance from one side edge of the plate to an opposing side edge of the plate.

11. The dryer of claim 10 wherein the preset distance is a linear function of a position on the bottom edge of the plate from one side edge of the plate to an opposing side edge of the plate.

12. The dryer of claim 10 wherein the distance between the bottom edge of the proportioning plates and the conveyor varies from the first end to the discharge end, so that each succeeding plate is a further distance from the conveyor than each preceding plate.

13. The dryer of claim 12 wherein the distance between the bottom edge of each proportioning plate and the conveyor is a linear function of a position of the plate between the first end and the discharge end of the conveying apparatus.

14. The conveying apparatus of claim 10 further comprising a deflector attached to the top edge of each proportioning plate, for distributing weight of the particulate material above the plates before it passes between the plates to the particulate material conveyor.

15. The conveying apparatus of claim 14 wherein the deflector is dimensioned and angled upwardly from the top edge of each plate from the discharge end to the first end of the apparatus, to substantially overlie at least a portion of a horizontal distance between adjacent plates.

16. The conveying apparatus of claim 10 further comprising essentially parallel, elongate, rigid members on each side of the proportioning plates, for attachment of the side edges of the plates therebetween.

17. The conveying apparatus of claim 16 wherein the proportioning plates are adjustably attached to the rigid members, such that a horizontal distance between each plate can be varied over the length of the conveying apparatus.

18. The conveying apparatus of claim 16 wherein the proportioning plates are adjustably attached to the rigid members, such that the distance between the bottom edge of each plate and the particulate material conveyor can be varied over the length of the conveying apparatus.

* * * * *

UNITED STATES PATENT AND TRADEMARK OFFICE

CERTIFICATE OF CORRECTION

PATENT NO. : 5,671,550

DATED : September 30, 1997

INVENTOR(S) : Christianus M. T. Westelaken

It is certified that error appears in the above-indentified patent and that said Letters Patent is hereby corrected as shown below:

Column 5, line 22, after "hopper" insert -- 50 --.

Column 5, line 28, after "material" insert -- 52. --.

Column 8, line 11, change "[2]Medium" to -- [1]Medium --.

Signed and Sealed this

Twelfth Day of May, 1998

*Attest:*

*Attesting Officer*

BRUCE LEHMAN

*Commissioner of Patents and Trademarks*